United States Patent [19]

Behlendorf et al.

[11] Patent Number: 4,944,102

[45] Date of Patent: Jul. 31, 1990

[54] HIGH PRODUCTION SYSTEM BUCKET

[75] Inventors: Donald J. Behlendorf, Franklin; Frederick J. Keip, Franksville, both of Wis.; Robert L. Benson, Underwood, N. Dak.

[73] Assignee: Bucyrus Erie Company, South Milwaukee, Wis.

[21] Appl. No.: 370,416

[22] Filed: Jun. 22, 1989

[51] Int. Cl.[5] ..... E02F 3/47

[52] U.S. Cl. ..... 37/135; 37/71; 37/115

[58] Field of Search ..... 37/71, 135, 116–117.5, 37/115

[56] References Cited

U.S. PATENT DOCUMENTS

| | | | |
|---|---|---|---|
| 758,380 | 4/1904 | Page | 273/399 |
| 945,547 | 1/1910 | Jones et al. | 414/645 |
| 1,014,293 | 1/1912 | Gade | 37/135 |
| 2,096,773 | 10/1937 | Weimer | 37/135 |
| 2,159,065 | 5/1939 | Weeks et al. | 294/73 |
| 2,200,315 | 5/1940 | Weimer | 37/135 |
| 2,249,070 | 7/1941 | Weimer | 37/71 X |
| 2,334,460 | 11/1943 | Weimer | 37/135 |
| 2,341,838 | 2/1944 | Bager | 37/116 |
| 2,669,042 | 2/1954 | Swank | 37/115 |
| 3,247,607 | 4/1966 | Page | 37/135 |
| 4,329,794 | 5/1982 | Rogers | 37/115 |
| 4,689,904 | 9/1987 | Briscoe | 37/135 |

*Primary Examiner*—Randolph A. Reese
*Assistant Examiner*—Arlen L. Olsen
*Attorney, Agent, or Firm*—Quarles & Brady

[57] ABSTRACT

A high production dragline bucket which has a low profile in the back wall as well as fewer components than those commonly in use. The bucket is not only lower in production costs, but has higher operating efficiencies. It is adaptable to both single or double sheave dumping assemblies. A replaceable basket portion for the bucket is also described.

10 Claims, 3 Drawing Sheets

HIGH PRODUCTION SYSTEM BUCKET

BACKGROUND OF THE INVENTION

This invention relates to a bucket system for use with large excavating apparatus and more particularly to a bucket which because of its design and construction provides a higly efficient bucket for operation with a dragline.

Dragline buckets, by their nature, must be designed in a rugged manner. They must also be constructed to handle large volumes of material. In most instances, dragline buckets are designated to handle from 30–130 cubic yards of material. Throughout the years, a typical standard dragline bucket was constructed with a high front arch to provide attachment to a dump line and structural integrity to the bucket lip and drag clevis plate structure, as well as a back wall approximately the same height as or only slightly lower than the side walls as to retain a maximum amount of material in the bucket. A typical standard dragline bucket of this design would be a Model BH 60-D available from the Bucryrus-Erie Company. When using these standard buckets with such a back wall in a dragline operation, the operator is inclined to attempt to fill the bucket to the top in all areas before dumping it. This rsults in an inefficient operation as the operator spends an excessive amount of time and energy dragging an almost completely filled bucket in order to fill a few more cubic yards of material. Further, the heavy back wall adds substantially to the weight and cost of the bucket. In addition to the previously described features, such a standard dragline bucket would also in most instances have the hoist chains attached to the outside of the bucket. This necessitates the use of a spreader bar to keep the hoist chains from engagement with the sides of the bucket.

The prior art does not provide a cost efficient dragline bucket wherein the weight of the bucket can be reduced to a minimum as well as the number of component parts. Neither does the prior art provide a dragline bucket having a low profile back which reduces weight and cost in manufacturing the bucket yet results in a more efficient operation.

It is an advantage of the present invention to provide an improved dragline bucket system resulting in higher production efficiency and at a lower cost.

It is another advantage of this invention to provide a dragline bucket system of the foregoing type wherein the back has a low profile and several component parts of prior art dragline buckets are eliminated.

It is an additional advantage of this invention to provide a dragline bucket system of the foregoing type which affordds a capacity increase while maintaining the service duty rating for a bucket of comparable standard design.

It is yet another advantage of this invention to provide a dragline bucket system of the foregoing type which is readily adaptable to conventional hoist, drag and dump lines.

It is still another advantage of this invention to provide a dragline bucket system of the foregoing type wherein a standard bucket can be modified to different sizes or capacities.

It is yet another advantage of this invention to provide a novel excavating bucket as well as a replaceable basket portion.

Other features and advantages of the invention will become apparent as well as an understanding of the invention from the description following.

SUMMARY OF THE INVENTION

The present invention contemplates a high production excaviting bucket system which includes a bucket having side walls, a rear wall and a floor having a forward lip with excaving teeth extending therefrom. Drag and dump lines are connected to forward portions of the bucket and hoist lines are connected to rearward portions of the side walls. The side walls have upper edge portions extending downwardly toward the rear wall to provide a low profile and partially open area at the rear of the bucket. The open area is constructed and arranged with respect to an upper edge portion of the rear wall to afford a complete dumping of the bucket before engagement with the hoist lines. In a preferred embodiment, the hoist lines are chains and are pivotally positioned inside the bucket and are devoid of any spreader means. Also preferably, the dump lines are connected to the bucket at forward portions of the side walls and a tubular support member extends between the side walls at the forward end of the bucket and at an upper portion thereof. The excavating system is adaptable to either a single or double sheave dumping assembly. In another preferred embodiment, the bucket has a partially open area at the rear of the bucket to afford a complete dumping and a replaceable basket portion is described for the bucket.

DECRIPTION OF THE PREFERRED EMBODIMENT

Figure 1:
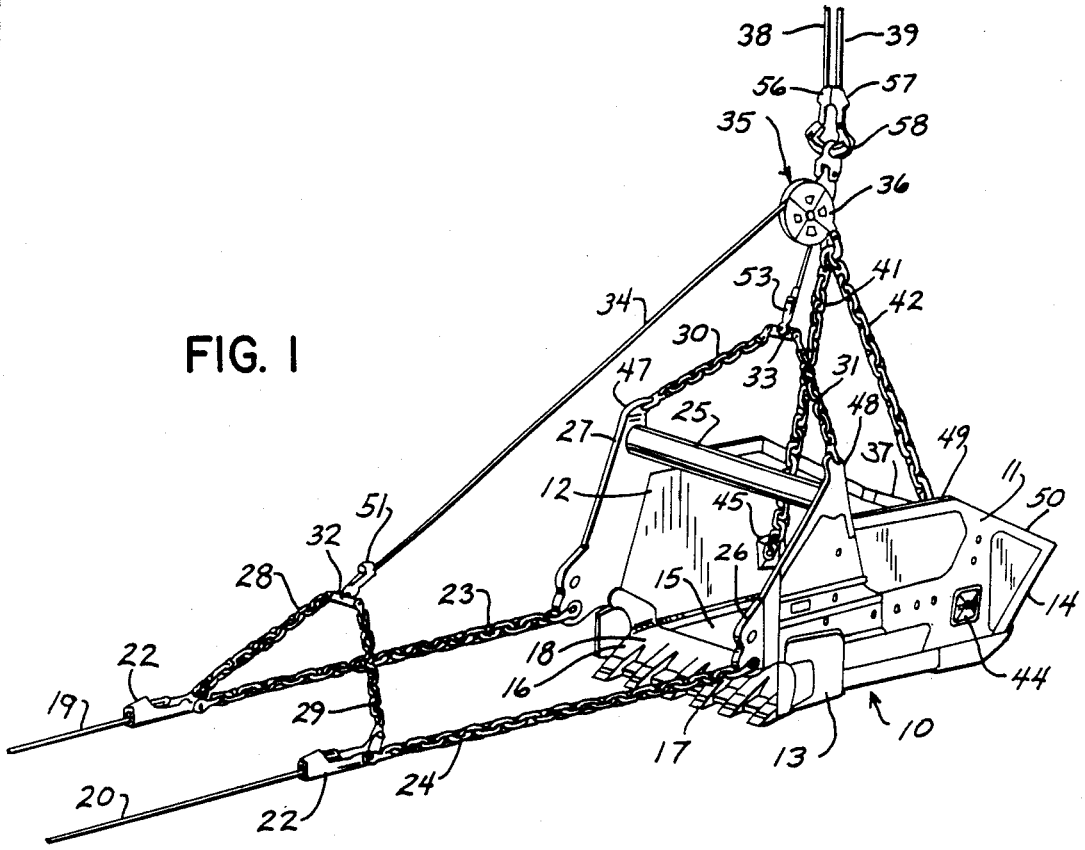
FIg. 1 is a perspective view of the high production excavating bucket of this invention.
Figure 2:
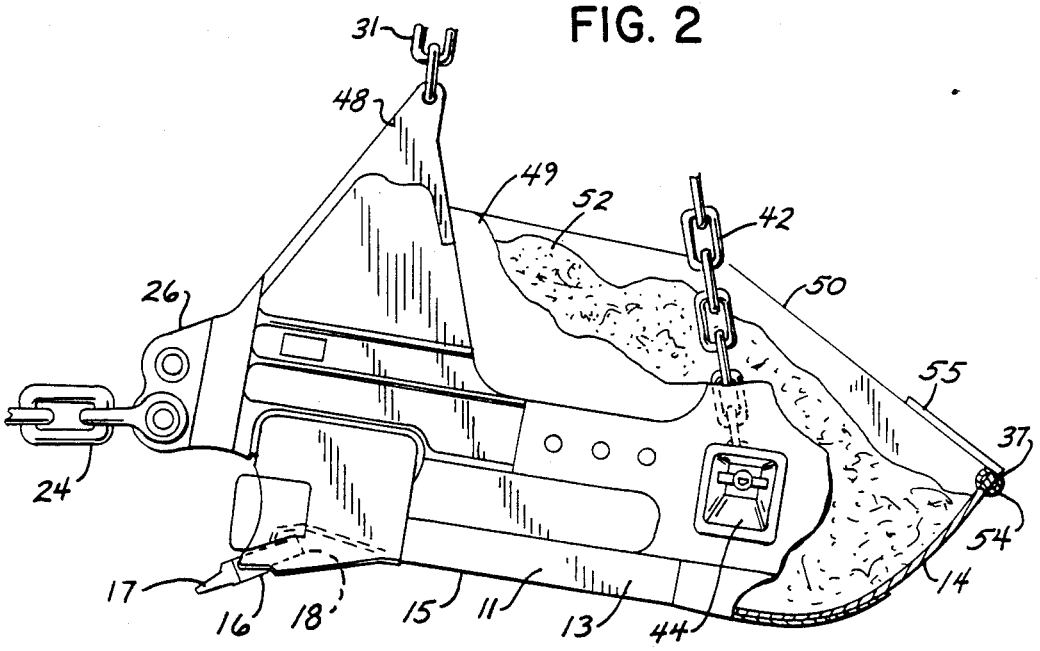
FIG. 2 is a view in side elevation and with a portion broken away of the bucket shown in FIG. 1.

Referring both to FIGS. 1 and 2, the high poduction bucket system generally 10 includes a bucket 13 having two opposite side walls 11 and 12 joined to a rear wall 14 and a floor 15. In the usual manner, excavating teeth 17 extend from the forward portion of the floor 15. Two drag ropes 19 and 20 are connected at one end to the usual dragline machine and at the other end to the rope sockets 22. The sockets in turn innerconnect to the dump chains 28 and 29 connected to a socket equalizer 32. A dump rope 34 connects to the socket equalizer 32 with rope socket 51 and extends over the usual sheave 36 of the dump block assembly generally 35. It is connected to another socket equalizer 33 with rope socket 53. Equalizer 33 is connected in turn to the dump chains 30 and 31. These in turn connect to clevis plates 26 and 27 by means for the inwardly directed attaching ears 47 and 48. Connected between the clevis plates 26 and 27 and the rope sockets 22 are the drag chains 23 and 24.

Two hoist ropes 38 and 39 connected at one of their ends to the usual dragline machine and at the other end to the dump block assembly 35 with rope sockets 56 and 57 and equalizer link 58. Also connected to the dump block assembly are the hoist chains 41 and 42 having their ends connected in a pivotal manner to the inside of the side walls 11 and 12 and by means of the trunnion brackets 44 and 45.

Figure 4:
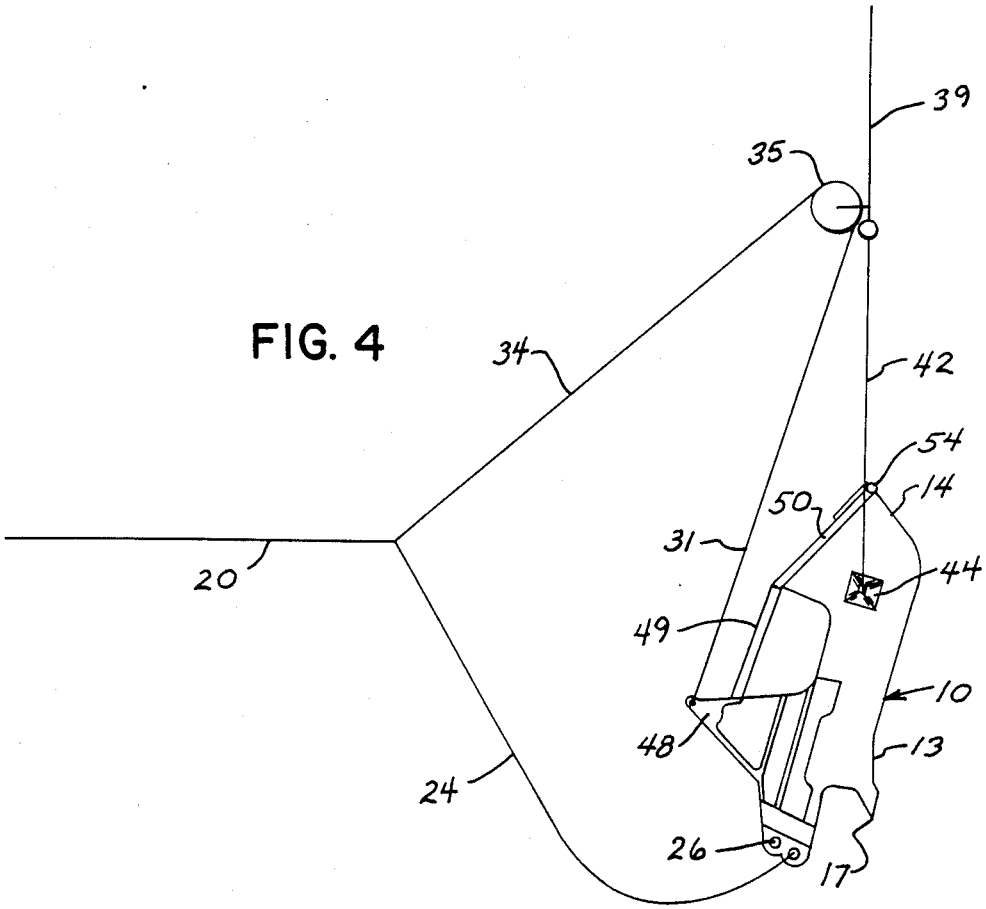
FIG. 4 is a view similar to FIG. 3 showing the bucket in a dumping mode.

An important feature of the bucket 13 is the fact that it has open profile back. This is effected by having each of the side walls 11 and 12 provided with inclined upper surfaces or edges 50 which extend from the straight surfaces or edge 49 of the side walls to the rear wall 14. Also extending across the upper surface or edge 37 of the rear wall 14 between where it is joined by the inclined side wall surfaces 50, is a bumper tube 54. The purpose of the bumper tube is to provide protection from engagement with the hoist chains 41 and 42 when the bucket 13 is in a dumping mode as shown in FIG. 4. Protective corner plates 55 are also secured to portions of the surfaces 50 and 37 where they join.

As mentioned earlier, another important feature of bucket 13 is the fact that it has eliminated the typical high front arch. This is replaced by the tubular support member 25 extending between the clevis plates 26 and 27.

Figure 5:
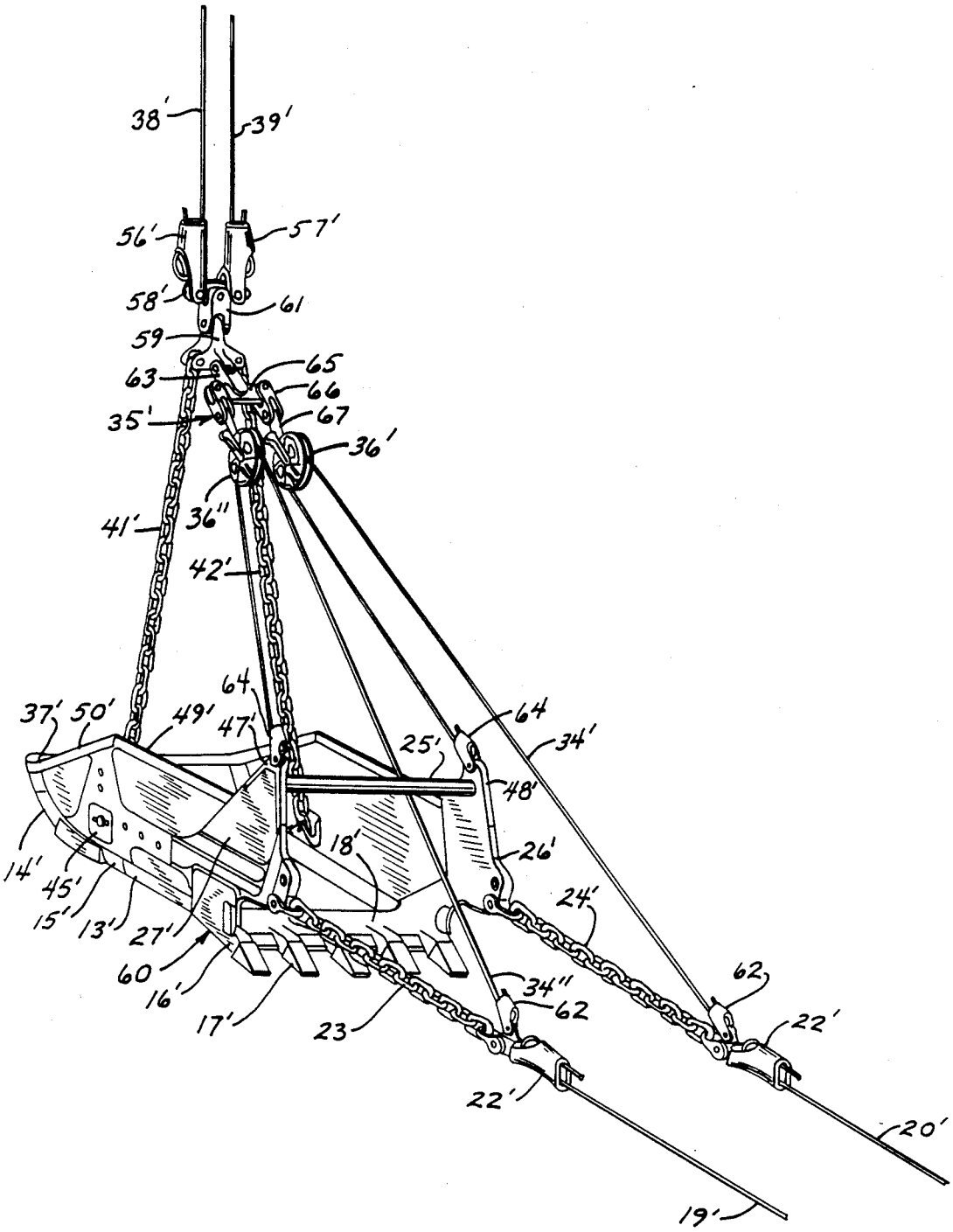
FIG. 5 is a veiw similar to FIG. 1 showing an alternative embodiment.

The bucket 13 has been described for use in conjunction with a single sheave 36 dump block assembly 35. If desired, the bucket 13 can be efficiently utilized with a double dump block assembly 35'. This is described in conjunction with the bucket system embodiment generally 60 shown in FIG. 5. Similar components are identified by the same numbers as previously described in conjunction with embodiment 10, except they are shown as "primed" or "double primed". The double dump block assembly 35' has two pivotally mounted dump blocks including sheaves 36' and 36". They are mounted by the connecting links 67 pivotally attached to the opposite plane links 66 which in turn are connected to the equalizer link 65. This equalizer link 65 is in turn pivotally attached to the opposite plane link 63 which is pivotally secured to the yoke 59. Yoke 59 is pivotally connected to the opposite plane link 61. The opposite plane link 61 is pivotally mounted to the equalizer link 58'. It will be seen that this arrangement, while employing two dump ropes 34' and 34" eliminates the dump chains 28, 29, 30 and 31 of the embodiment 10. The dump ropes 34' and 34" are each connected to drag ropes 20' and 19', respectively. This connection is provided through the sockets 22' and 62. In eliminating the dump chains 28, 29, 30 and 31 and the associated socket equalizers 32 and 33, the embodiment 60 has the advantage of providing a lighter rigging as well as being easier to maintain.

Figure 3:
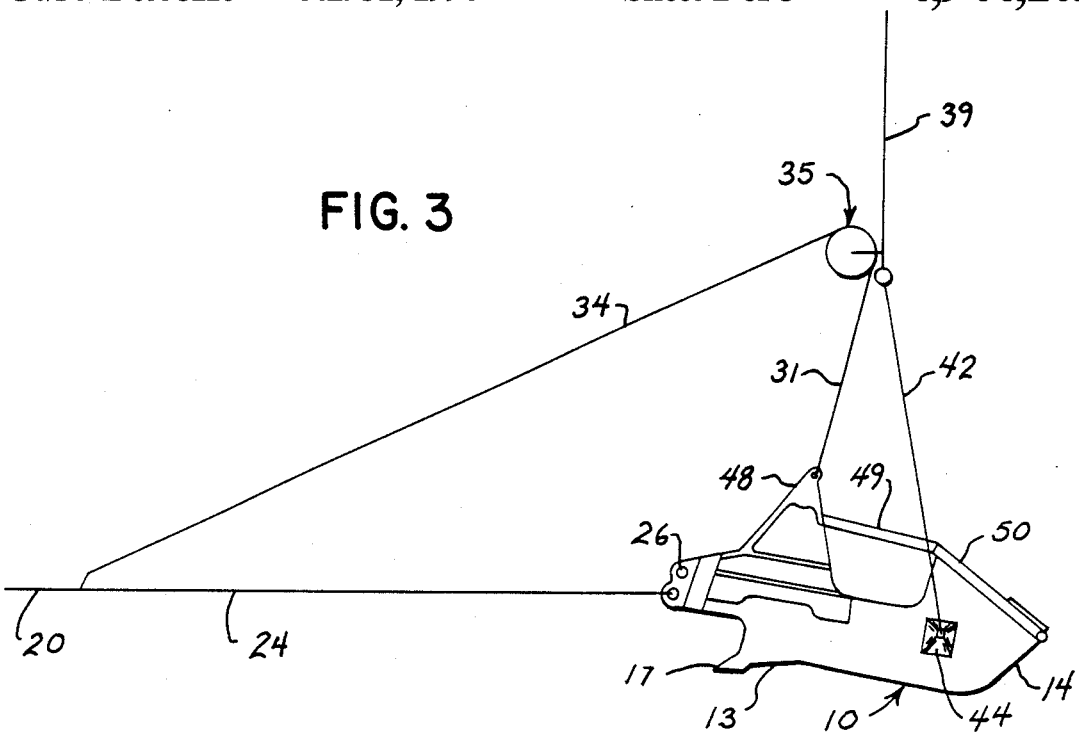
FIG. 3 is a diagrammatic view of the bucket of FIG. 1 shown in an excavating position.

In addition to having fewer component parts and thus a lighter weight bucket than previously utilized for a dragline bucket of comparable size, another advantage of bucket systems 10 and 60 will be seen from a description of the operation of bucket system 10 as shown in FIGS. 3 and 4. It will be understood that the same operational advantages apply with respect to embodiment 60.

OPERATION

The bucket 13 is shown in the usual filling mode in FIG. 3 wherein only one of the drag ropes, drag chains, dump chains, hoist ropes, and hoist chains is illustrated. As shown in FIg. 3, the hoist rope 39 is lowered and a dragging force is exerted on the drag rope 20. In the usual manner, this exerts a pulling force on the drag chain 24 as well as on the dump rope 34 and the dump chain 31 to give the bucket 13 an attitude for excavating as shown in FIg. 3. As the bucket is pulled to excavate and receive, for example overburden, it will fill into the bucket 13 until the load 52 has a profile as depicted in FIG. 2.

In this instance, the bucket 13 has a taper to the side walls 11 and 12 toward the bottom floor 15 as well as tapering toward the rear wall 14. This tapering allows for faster fills and swells. It also permits easier carrying of the load. When the bucket is filled with the load 52 as indicated in FIG. 2, it is then ready for dumping. It should be pointed out that although the bucket does not have a complete back in the sense of the rear wall extending to the same level as the side walls, this is not a disadvantage from a capacity standpoint. In fact, the opposite is true. Where prior standard higher back wall excavating buckets have been employed, and as previously indicated, it is the tendency of the operator to continuously try to fill the bucket 13 to the top at the rear thereof. This results in a diminshing return situation in that the operator is dragging a large bucket with a large load in order to try to fill the bucket to the maximum. This results in loss of energy as well as increased operating time. An additional benefit of the reduced height rear wall is the fact that during the filling portion of the operating cycle, a slight overdragging of the bucket permits some material to flow through the entire length of the bucket and out of the low back end, thereby eliminating the tendancy for material to adhere in dead zones as in prior art standard buckets where flow through was not possible.

When it is desired to dump the load 52, the bucket 13 will be place in a dumping mode as shown in FIG. 4. This is effected in the usual manner by a lift on the hoist rope 39 while leaving slack on the drag rope 20. It should be noted in this instance that efficient pivoting of the bucket is effected by the location of the trunnion brackets 44 in the area usually below the tapering side wall 50 surfaces. Note the relative short distance between the attachment of the dump chains 30 and 31 at 47 and 48 to the bucket 13 and the attachment of the hoist chains 41 and 42 at the trunnion brackets 44 and 45. This allows for faster dumping of the bucket 13. Due to the low profile of the rear wall 14, maximum pivoting of the bucket 13 is effected before the hoist chains 41 and 42 engage the upper portion of the rear wall 14. In this instance, it is protected by the previously indicated bumper tube 54. Note also in this instance the almost vertical position which the bucket 13 can obtain before any potential engagement with the hoist chains 41 or 42. It should also be pointed out that bucket 13 has a taper from the front to rear of the side walls 11 and 12 as well as the floor 15. This also assists in cleaner and faster dumps. After the load 52 is dumped, the bucket 13 will then assume the position shown again in FIG. 3 by means of the previously indicated pulling force on the drag rope 20 and a lowering of the hoist ropes 38 and 39.

In manufacturing either bucket 13 or 13', it is sometimes preferable to construct the front ring weldment or assembly separate from the basket portion of the bucket and to secure them in a unitary manner such as by welding or by mechanical attachment. The front ring assembly is that at the front of the bucket as represented by the support tubes 25 and 25', the clevis plates 26, 27 and 26', 27' and bucket lips 18 and 18' which provides attachment for the wearable teeth 17 and 17' through the adapters 16 and 16'. The basket portion of the buckets 13 and 13' would include the side walls 11, 12 and 11', 12', the rear walls 14 and 14' and the floors 15 and 15'.

The basket portion could be fabricated of a wall thickness so that the ring assembly would outlast several changes of the basket portion.

As stated previously, bucket system 10 eliminates the previously used high arch at the front of the bucket as well as the standard higher back. This is also true with respect to bucket system 60. In addition it has been found that buckets 13 and 13' can be constructed with lighter clevis plates 26, 27 and 26', 27' and that the usual trunnion deflectors for the hoist chains can be eliminated. In fact, the trunnions themselves can be reduced in weight and are placed in the side wall to allow for a small silhouette inside the bucket to minimize any hindering of the material to fill and empty from the bucket. Other advantages are the elimination of the usual spreader bar for the hoist chains due to the fact that the chains are located inside the buckets 13 and 13'. This has still another advantage in that in case a hoist chain fails, less subsequent structural damage will occur to the bucket body than in a commonly used standard designed bucket. Still further is the advantage that dump chains 28, 29, 30 and 31 are indentical as are the socket equalizers 32 and 33. This means fewer different parts are required with respet to bucket system 10.

Because of the low profile design of the buckets 13 and 13' at the rear thereof, as well as the fewer components utilized in these bucket systems 10 and 60, and increase in production up to 20% and possibly more is achieved. Another distinct advantage of these bucket systems is the fact that they are adaptable to various bucket sizes. For example, they can be fabricated in a wide range of bucket sizes of larger capacity than their standard designed bucket counterparts, and still maintain the same service duty rating of that standard designed bucket. This allows bucket capacity increases without any sacrifice in service duty rating or basic bucket body structural design integrity.

The term "service duty rating" as used herein is an industry recognized term and relates to the total rigged bucket weigth in terms of pounds divided by the bucket capacity in terms of cubic yards. Heavy service duty rated buckets are used in severe impact applictions where a high percentage of rock or consolidated material exists in the mine. Light service duty rated buckets are used in easily dug, low impact and loose material conditions such as sand and loose overburden. Medium service duty rated buckets would fall between the heavy and light duty rated ones. A comparison of the standard heavy, medium and light service duty rated buckets with the buckets of this invention follows wherein the weights indicated are approximate:

| | |
|---|---|
| Heavy | Standard Buckets = 1900–2100* |
| | Bucket Systems 10 and 60 = 1500–1700* |
| Medium | Standard Buckets = 1750–1950* |
| | Bucket Systems 10 and 60 = 1400–1550* |
| Light | Standard Buckets = 1600–1750* |
| | Bucket Systems 10 and 60 = 1200–1400* |

*indicates pounds of total rigged bucket weight per cubic yard of bucket capacity.

We claim:

1. A high production excavating bucket sytem comprising:

a bucket having side walls, a rear wall and a floor having a forward lip with excavating teeth extending therefrom; and drag and dump lines connected to a forward portion of said bucket and hoist lines connected to rearward portions of said side walls;

said side walls having upper wall edges, a major forward portion of which is substantially parallel to the floor and a rear portion of which slopes downwardly to a top edge of the rear wall to provide a partially open area of the rear of said bucket, said open area defined by the rear portions of the upper wall edges of the side walls and the top edge of the rear wall to afford a complete dumping of said bucket before engagement with said hoist lines.

2. The invention of claim 1 wherein said hoist lines are provided by hoist chains which are pivotally positioned inside said bucket.

3. The invention of claim 2 wherein said hoist chains are devoid of any spreader means.

4. The invention of claim 1 wherein said hoist chains are connected to said side walls at a point between the downwardly sloping upper edges of said side walls and the floor.

5. The invention of claim 1 wherein said dump lines are connected to said bucket at forward portions of said side walls.

6. The invention of claim 1 wherein a tubular support member extends between said side walls at said forward portion of said bucket and at an upper portion thereof.

7. The invention of claim 1 wherein there are two of said dump lines which are connected to said bucket by means of a double sheave assembly.

8. The invention of claim 1 wherein said upper edge of said rear wall has a bumper tube placed thereover.

9. A high production excavating bucket comprising:

side walls, a rear wall and a floor having a forward lip with excavating teeth extending therefrom, said side walls defined by forward portions extending toward said lip and reaward portions extending toward said rear wall, said side walls sloping inwardly toward said floor and downwardly toward a top edge of said rear wall;

drag and dum lines connected to forward portions of said bucket;

hoist chains; and means to pivotally connect said hoist chains to said rearward portions of said side walls and inside thereof, said means including pivot points positioned to effect a dumping of said bucket toward said lip.

10. In a high production excavating bucket having side walls, a rear wall and a floor having a forward lip with excavating teeth extending therefrom, the improvement comprising:

said side walls of said bucket having forward edges that define an open front of the bucket with the lip, said side walls having upper edges that define a profile having a forward portion that is generally parallel to the floor and a rearward portion that inclines rearwardly and downwardly from the forward portion to a top of the rear wall, the top of said rear wall being at a subtantially lower height than the open front of the bucket to provide a partially open area of the rear of said bucket to afford a complete dumping of said bucket when hoist chains are connected thereto, said side walls of said bucket including means to attach said hoist chains to the inside thereof.

* * * * *

UNITED STATES PATENT AND TRADEMARK OFFICE

CERTIFICATE OF CORRECTION

PATENT NO. : 4,944,102

DATED : July 31, 1990

INVENTOR(S) : Behlendorf et al.

It is certified that error appears in the above-identified patent and that said Letters Patent is hereby corrected as shown below:

| | |
|---|---|
| Column 1, line 8 | "higly" should read --highly-- |
| Column 1, line 27 | "rsults" should read --results-- |
| Column 1, line 55 | "affordds" should read --affords-- |
| Column 2, line 7 | "excaviting" should read --excavating-- |
| Column 2, line 9 | "excaving" should read --excavating-- |
| Column 2, line 46 | "poduction" should read --production-- |
| Column 2, line 48 | "opposite" should read --opposing-- |
| Column 2, line 64 | "connected" should read --connect-- |
| Column 3, line 8 | "edge" should read --edges-- |
| Column 4, line 31 | "will be place" should read --will be placed-- |
| Column 5, line 22 | "indentical" should read --identical-- |
| Column 5, line 24 | "respet" should read --respect-- |
| Column 5, line 27 | "and" (second occurrence) should read --an-- |

UNITED STATES PATENT AND TRADEMARK OFFICE

CERTIFICATE OF CORRECTION

PATENT NO. : 4,944,102

DATED : July 31, 1990

INVENTOR(S) : Behlendorf et al.

It is certified that error appears in the above-identified patent and that said Letters Patent is hereby corrected as shown below:

Column 5, line 41 "weigth" should read --weight--

Column 5, line 43 "applictions" should read --applications--

Column 6, line 18 "claim 1" should read --claim 2--

Signed and Sealed this

Tenth Day of December, 1991

*Attest:*

HARRY F. MANBECK, JR.

*Attesting Officer*

*Commissioner of Patents and Trademarks*